US005663560A

United States Patent [19]

Sakairi et al.

[11] Patent Number: 5,663,560

[45] Date of Patent: *Sep. 2, 1997

[54] METHOD AND APPARATUS FOR MASS ANALYSIS OF SOLUTION SAMPLE

[75] Inventors: Minoru Sakairi, Kawagoe; Tadao Mimura, Hitachinaka; Yasuaki Takada; Takayuki Nabeshima, both of Kokubunji; Hideaki Koizumi, Tokyo, all of Japan

[73] Assignee: Hitachi, Ltd., Tokyo, Japan

[ * ] Notice: The term of this patent shall not extend beyond the expiration date of Pat. No. 5,481,107.

[21] Appl. No.: 555,192

[22] Filed: Nov. 8, 1995

Related U.S. Application Data

[63] Continuation-in-part of Ser. No. 302,555, Sep. 8, 1994, Pat. No. 5,481,107.

[30] Foreign Application Priority Data

Sep. 20, 1993 [JP] Japan ..... 5-232833
Oct. 27, 1995 [JP] Japan ..... 7-280159

[51] Int. Cl.[6] ..... H01J 49/06

[52] U.S. Cl. ..... 250/281; 250/288

[58] Field of Search ..... 250/288, 288 A, 250/281

[56] References Cited

U.S. PATENT DOCUMENTS

| | | | |
|---|---|---|---|
| 4,999,492 | 3/1991 | Nakagawa | 250/281 |
| 5,376,791 | 12/1994 | Swanson et al. | 250/309 |
| 5,426,301 | 6/1995 | Turner | 250/288 |
| 5,481,107 | 1/1996 | Takada et al. | 250/281 |

FOREIGN PATENT DOCUMENTS

| | | |
|---|---|---|
| 0 237 259A2 | 9/1987 | European Pat. Off. . |
| 0 358 212 | 3/1990 | European Pat. Off. . |
| 278143A | 3/1990 | Japan . |

OTHER PUBLICATIONS

Analytical Chemistry, vol. 59, No. 22, Nov. 15, 1987, pp. 2642–2646.

*Primary Examiner*—Jack I. Berman
*Attorney, Agent, or Firm*—Kenyon & Kenyon

[57] ABSTRACT

A method in which cutting of small droplets, neutral particles or photons through to a slit provided between a differential pumping portion and a mass analysis portion is combined with slight deflection of ions just before introduction of the ions into the mass analysis portion so that noises are greatly reduced without reduction of signals to thereby improve the signal-to-noise ratio which is an index of detecting sensitivity or lower limit.

69 Claims, 18 Drawing Sheets

A : ACCUMULATING IONS
B : COOLING IONS
C : SCANNING

METHOD AND APPARATUS FOR MASS ANALYSIS OF SOLUTION SAMPLE

CROSS-REFERENCE TO RELATED APPLICATION

This application is a continuation-in-part of U.S. application Ser. No. 08/302,555, filed on Sep. 8, 1994, now U.S. Pat. No. 5,487,107, the disclosure of which is hereby incorporated by reference.

BACKGROUND OF THE INVENTION

The present invention relates to an ionization method or ion source for ionizing a matter contained in a solution under atmospheric pressure or similar pressure and a mass spectrometry or mass spectrometer using the ionization method or ion source, and also relates to a liquid chromatograph/mass spectrometer, a capillary electrophoresis system/mass spectrometer and a plasma mass spectrometer.

As the related art, three techniques may be taken as examples as follows.

The first one of the examples of the related art is a method used in a plasma mass spectrometer, as disclosed in JP-A-2-248854 (U.S. Pat. No. 4,999,492). FIG. 16 is a reference view showing the method. In the method, ions generated by inductively coupled plasma are introduced into a high vacuum through a differential evacuation portion. In this occasion, in order to reduce noises due to high-speed neutral particles and photons mainly generated by plasma, ions extracted by an ion extraction lens 19 through an ion take-out aperture 7 of the differential evacuation portion are deflected by a deflector 20 and introduced into a mass analysis portion 13 through an ion take-in aperture 12 so that the high-speed neutral particles and photons going straight are cut partially.

The second example of the related art is the technique which is disclosed in JP-A-7-85834. FIG. 17 is a reference view showing the technique. The technique is adapted not only to a plasma mass spectrometer but also to a liquid chromatograph/mass spectrometer using a mass spectrometer as a detector of a liquid chromatograph to separate a mixture sample in solution, and a capillary electrophoresis system/mass spectrometer using a mass spectrometer as a detector of a capillary electrophoresis system to separate a mixture sample in solution. In this occasion, noises in the detector are mainly caused not by high-speed neutral particles and photons but by small droplets flowing into a high vacuum through a differential evacuation portion. In the case of a liquid chromatograph/mass spectrometer or a capillary electrophoresis system/mass spectrometer, there is employed a method in which electrically charged droplets are basically generated by spraying a solution and solvent molecules are vaporized from the electrically charged droplets to thereby generate ions of sample molecules. Accordingly, the electrically charged droplets thus generated are not always vaporized thoroughly, so that small droplets which are not vaporized inevitably remain. The not-vaporized small droplets flow into the high vacuum through the differential evacuation portion and reach the detector to cause big noises. In this technique, a double-cylindrical electrostatic lens is used as an electrostatic lens for deflecting and focusing ions. In this occasion, a large number of apertures are opened in an inner cylindrical electrode 10, so that ions are deflected and focused by using an electric field coming from the apertures of the inner cylindrical electrode 10 by the change of the voltage between the inner cylindrical electrode 10 and an outer cylindrical electrode 11 to thereby remove the small droplets, or the like, as the cause of noises.

The third example of the related art is the technique which is a method described in EP-A-0237249. FIG. 18 is a reference view showing the method. In the method, three quadrupole sets employing a high-frequency electric field are used. A first quadrupole set 26 has a function for mass-analyzing or focusing ions generated by an ion source 24 and focused by a lens 25. A second quadrupole set 27 is bent with a certain curvature. A detector 14 is disposed in the rear of a third quadrupole set 28 which has a function for mass-analyzing ions. Because the second quadrupole set 27 is bent with a certain curvature, ions having electric charges pass through the curved quadrupole set but neutral particles and droplets having no electric charges go straight. Accordingly, the neutral particles and droplets do not reach the detector 14 disposed in the rear of the third quadrupole set 28 for mass-analyzing ions, so that the noise level in the detector 14 is reduced correspondingly.

In the above first example, if the quantity of ion deflection is increased, the flowing of neutral particles, photons, etc., into the mass analysis portion can be prevented so that the noise level in the detector can be reduced correspondingly. If the quantity of ion deflection is increased, however, it becomes correspondingly difficult to focus ions again at the ion take-in aperture 12 of the mass analysis portion after deflection of ions. This is because the ion beam is widened at the ion take-in aperture 12 of the mass analysis portion or the angle of ions incident to the ion take-in aperture 12 of the mass analysis portion is increased. If the focus condition at the ion take-in aperture 12 of the mass analysis portion is poor, the ion transmission efficiency through the mass analysis portion becomes low so that the ion intensity of a sample to be measured, that is, the signal intensity is lowered. Accordingly, in the method, the signal intensity is reduced simultaneously with the reduction of noises even in the case where noises caused by high-speed neutral particles or photons are reduced by high ion deflection, so that it is finally impossible to improve greatly the signal-to-noise ratio as an index of detecting sensitivity.

Although the above description has shown the case where a quadrupole mass spectrometer is used as the mass spectrometer, this problem will become more serious when a special mass spectrometer such as an ion trap mass spectrometer, or the like, is used in the first example of the related art. In the case of a quadrupole mass spectrometer, the ion take-in aperture 12 of the mass analysis portion has a relatively large diameter of about 3 mm. Accordingly, even in the case where the focus condition at the ion take-in aperture 12 of the mass analysis portion is poor, that is, the ion beam is spread at the ion take-in aperture 12 of the mass analysis portion, the transmission efficiency of ions is not so greatly reduced. In the case of an ion trap mass spectrometer of the type in which ions are enclosed in a region surrounded by a pair of an end cap electrode and a ring electrode, however, the ion take-in aperture provided in the end cap electrode cannot be made so large because the disturbance of a high-frequency electric field in the inside cannot be made so large. Generally, the diameter of the ion take-in aperture in the case of an ion trap mass spectrometer is about 1.3 mm, which is smaller than that, in the case of a quadrupole mass spectrometer. Accordingly, in the case of an ion trap mass spectrometer, it has been confirmed that the lowering of the transmission efficiency of ions becomes remarkable if the ion beam is spread at the ion take-in aperture when ions are deflected in the manner as described above.

Also in the second example of the related art, the signal intensity is reduced simultaneously with the reduction of noises even in the case where ions are deflected greatly to reduce noises caused by droplets and neutral particles, the signal-to-noise ratio as an index of detecting sensitivity finally cannot be improved greatly.

In the third example of the related art, the apparatus becomes not only very complex but also very expensive. The quadrupole sets are required to be mechanically finished with accuracy of the order of microns, and the electrodes in the second quadrupole set are required to be bent with a certain curvature. Furthermore, a high-frequency electric source must be used in the quadrupole sets. Particularly in the case where electrodes in the second quadrupole set are bent with a large curvature in order to reduce noises greatly, there arises a serious problem in machining.

SUMMARY OF THE INVENTION

The present invention solves the aforementioned problems by providing an apparatus for mass analysis which comprises: a sample supply unit for supplying a sample in solution; an atomizer for atomizing the sample solution; an ion source for ionizing a predetermined matter in the atomized sample solution to thereby form a particle stream constituted by electrically charged particles and neutral particles; a differential evacuation portion including an aperture for leading the particle stream to a vacuum analysis portion, and an electric source for applying a voltage to the aperture; a focusing lens for focusing the electrically charged particles contained in the particle stream; a deflector for deflecting the electrically charged particles; a mass spectrometer for measuring the value of mass-to-charge ratio of the charged particles; and a limit plate for limiting the flow path of the particle stream, the limit plate being provided between the focusing lens and the mass spectrometer.

More in detail, it is only necessary that small droplets, neutral particles or photons (which concern only the case of a plasma mass spectrometer) as the cause of noises in a detector are cut efficiently from the particle stream constituted by electrically charged particles and electrically neutral particles, inclusive of droplets, solvent molecules, atmospheric gas molecules and ions, without so much increasing the quantity of ion deflection before ions are introduced into the mass analysis portion which estimates a value of mass-to-charge ratio of charged particles. To this end, ions extracted through an ion take-out aperture of the differential evacuation portion are once focused by the focusing lens in the condition in which a limit plate, that is, a slit for cutting a large part of droplets, neutral particles or photons (which concern only the case of a plasma mass spectrometer) as the cause of noises is placed on the focal point of the focusing lens. In this manner, ions pass through the slit efficiently because ions are focused at the position of the slit, whereas a large part of small droplets, neutral particles or photons (which concern only the case of a plasma mass spectrometer) are cut efficiently at this slit portion because such small droplets, neutral particles or photons which are not affected or focused by an electric field are spread spatially after passing through an ion take-out aperture of the differential evacuation portion. That is, ions are deflected so as to be introduced into the mass analysis portion after passing through the slit, whereas small droplets, neutral particles or photons (which concern only the case of a plasma mass spectrometer) a large part of which have been cut at the slit position go straight and collide with the wall of the mass analysis portion so as to be withdrawn. Further, with such a configuration, the object of the present invention can be achieved by a simple and inexpensive configuration without requiring any complicated configuration.

In short, the method of the related art attempts to improve the signal-to-noise ratio merely by deflecting ions greatly, whereas the present invention attempts to greatly improve the signal-to-noise ratio by combining cutting of small droplets, neutral particles or photons through a slit and slight deflection of ions.

Among droplets as the cause of noises, there are droplets electrically charged. These electrically charged droplets have a very large mass compared with ions analyzable in the mass analysis portion, so that these electrically charged droplets obtain large kinetic energy corresponding to the streaming thereof when the droplets flows into a vacuum through the aperture. The orbit of these electrically charged droplets is bent by an electrostatic lens but the quantity of deflection of the orbit thereof is relatively small compared with the quantity of deflection of the orbit of ions. Accordingly, because the position of ions focused by the electrostatic lens is different from the position of electrically charged droplets focused by the electrostatic lens, a large part of electrically charged droplets can be removed when a slit is disposed in the neighborhood of the position of ion focus.

DESCRIPTION OF THE PREFERRED EMBODIMENTS

Figure 1:
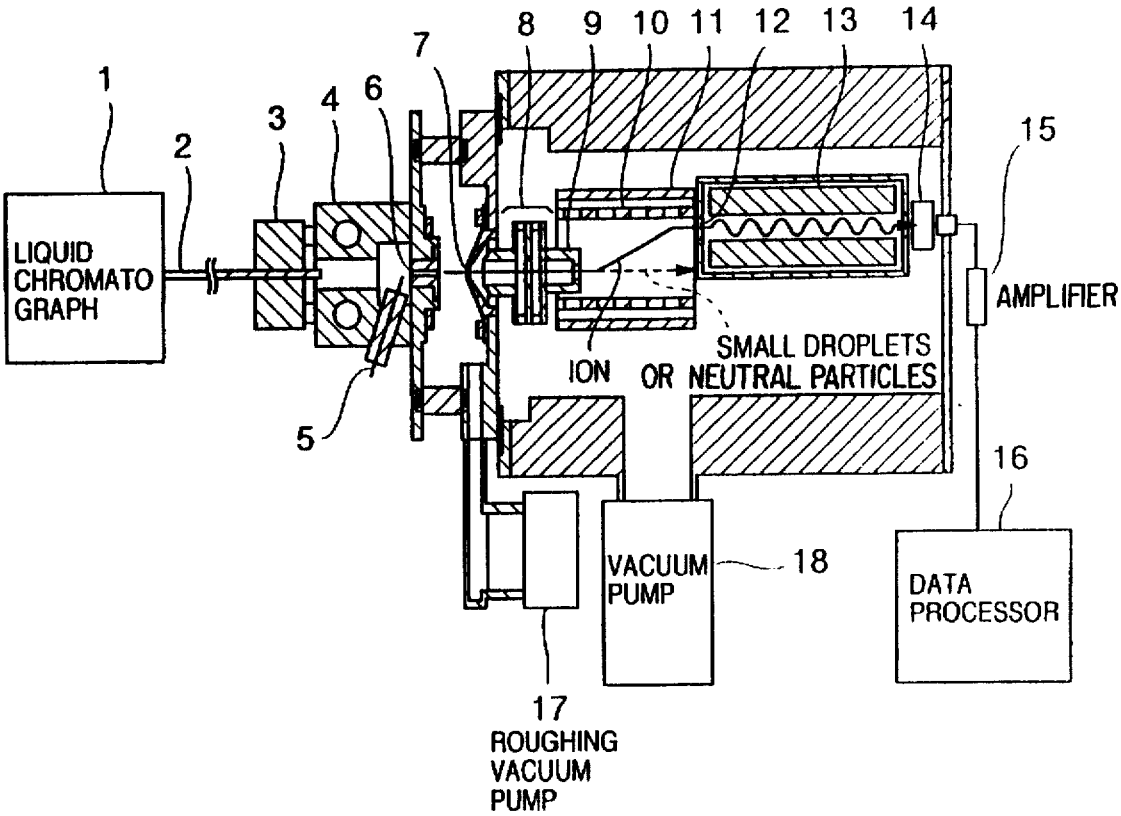
FIG. 1 is a structural view of an apparatus showing an embodiment of the present invention.
Figure 2:
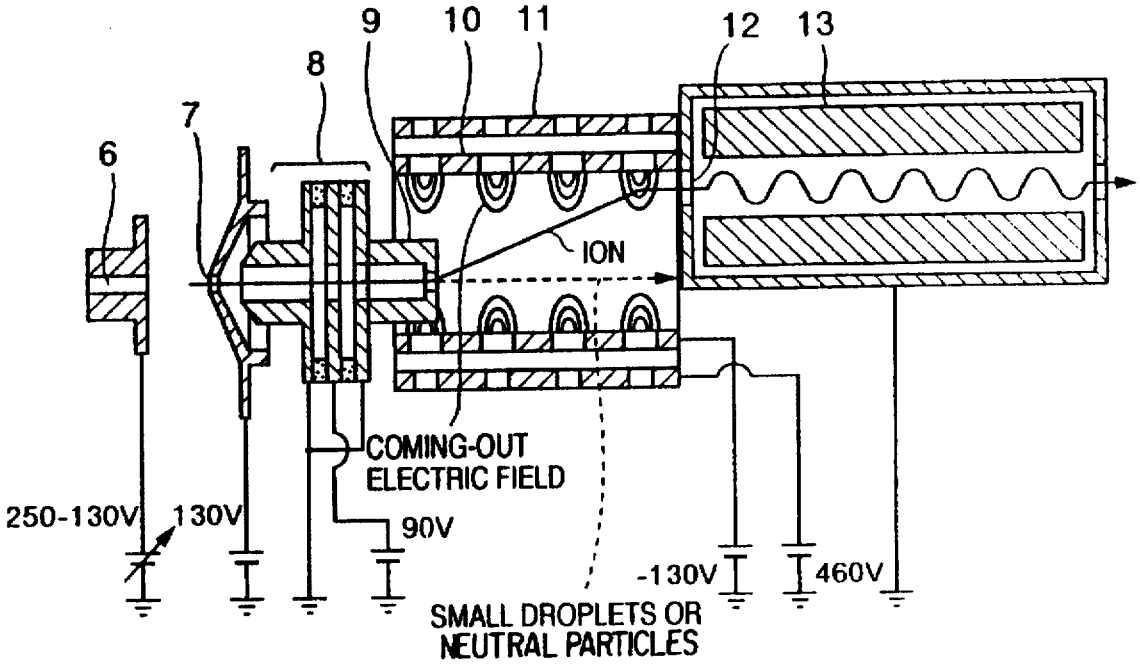
FIG. 2 is an enlarged view of a slit portion.

Referring to FIG. 1, there is shown an embodiment of a liquid chromatograph/mass spectrometer using a so-called atmospheric pressure chemical ionization method which in which ions are generated under atmospheric pressure or similar pressure. FIG. 2 is an enlarged view of a portion having a slit 9 which is the point of the present invention for reference. Not only the same discussion can be applied to the case where another atmospheric pressure ionization method (such as an electrospray in which electrically charged droplets are generated by electrostatic spraying, an atmospheric pressure spraying method in which electrically charged droplets are generated by heat spraying, sonic spray method in which electrically charged droplets are generated by using a sonic-speed gas, or the like) is used) but also the same effect can be expected in a capillary electrophoresis system/mass spectrometer.

A sample in a solution separated by a liquid chromatograph 1 passes through a pipe 2 so that the sample solution is first nebulized by a nebulizer 3. Nebulizer 3 nebulizes the sample solution by heat spraying or gas spraying. Then, the nebulized sample solution is introduced into a vaporizer 4 which is heated up to a temperature in a range of from about 100° to 500° C. so that the nebulized sample solution is further vaporized. The thus generated small droplets and molecules are introduced into a region of corona discharge generated by applying a high voltage to a pointed end of a needle electrode 5. In this region, ions containing electrically charged droplets are generated by corona discharge followed by an ion molecule reaction.

The ions containing electrically charged droplets pass through an ion take-in aperture 6 (aperture diameter: about 0.25 mm, length: about 20 mm) in a differential pumping portion which is heated to a temperature in a range of from 50° to 150° C., and then the ions are introduced into the differential pumping portion. Then, after passing through the differential pumping region, ions are extracted by an electrostatic lens 8 through an ion take-out aperture 7 (aperture diameter: about 0.2 mm, length: about 0.5 mm) of the differential pumping portion. This region is generally evacuated from 10 to 0.1 Torr by a roughing vacuum pump 17. Another electrode having an aperture provided between the ion take-in aperture 6 of the differential pumping portion and the ion take-out aperture 7 of the differential pumping portion may be provided in the differential pumping portion. This is because an ultrasonic-speed streaming region (in which there is no collision between molecules, so that the temperature is reduced correspondingly) which is generated when ions flow into the differential pumping portion through the ion take-in aperture of the differential pumping portion is compressed so that the efficiency of vaporizing droplets flowing into the differential pumping portion is not reduce.

Figure 3A:
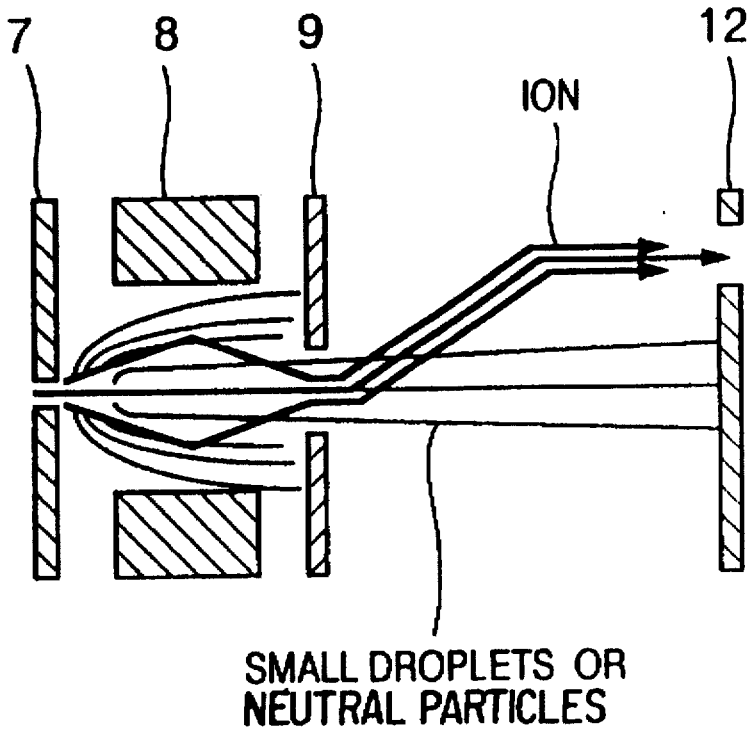
FIGS. 3A and 3B are conceptual views for explaining the meaning of the slit.
Figure 3B:
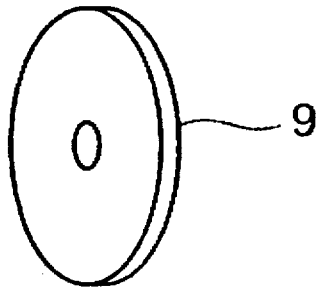

FIG. 2 is an enlarged view showing a range of from the ion take-in aperture 6 of the differential pumping portion to a quadrupole mass analysis portion. Generally, a voltage is applied between the ion take-in aperture 6 of the differential pumping portion and the ion take-out aperture 7 for the double purposes of improving ion transmission efficiency and generating desolvated ions. Ions extracted through the ion take-out aperture 7 of the differential pumping portion are once focused by the electrostatic lens 8. FIG. 1 shows the case where an Einzel lens, which is a very popular electrostatic lens, is provided as an example of the electrostatic lens 8. This lens is composed of three electrodes. Among the three electrodes, two electrodes opposite to each other have the same electric potential and one electrode located in the center has an electric potential which is changed to thereby change the focal length of ions. Holes having the same diameter (in this system, about 7 mm holes) are provided in the neighborhood of the center axis of the three electrodes, so that ions pass through this hole portion. In the Einzel lens herein used, the electrode located in the ion take-out aperture 7 side of the differential pumping portion has a projected shape for the purpose of improving the efficiency of extraction of ions through the ion take-out aperture 7 of the differential pumping portion. In the electrode opposite to the Einzel lens, a slit 9 for narrowing small droplets and neutral particles flowing thereinto simultaneously with ions through the ion take-out aperture of the differential pumping portion is provided in the position of the focal point of the lens. This slit 9 is obtained by forming a hole having a diameter of about 2 mm in the center. A large part of small droplets and neutral particles flowing into the lens through the ion take-out aperture of the differential pumping portion and spread spatially are cut so that the small droplets and neutral particles are prevented as efficiently as possible from flowing into the mass analysis portion side. Considering the focusing condition, the diameter of the slit 9 is preferably selected to be in a range of from about 0.5 mm to about 5 mm so as to be smaller than the center diameter of the electrostatic lens 8. As shown in the conceptual views of FIGS. 3A and 3B, the slit 9 has a function of cutting neutral small droplets and neutral particles but there is no risk of reduction of ion transmission efficiency due to the provision of the slit 9 if the focal length of the electrostatic lens 8 provided in front of the slit 9 is changed so that ions are focused at the position of the slit by the electrostatic lens 8. In this occasion, if the aperture size of the slit 9 is not smaller than the aperture size of the electrostatic lens 8 provided in front of the slit 9, there is no meaning of the slit. That is, the important meaning of the present invention is in that small droplets and neutral particles are reduced in a stage in which ions are extracted through the ion take-out aperture 7 of the differential pumping portion and focused by the electrostatic lens 8. If the aperture size of the electrostatic lens 8 is reduced to 2 mm so that the electrostatic lens 8 can serve also as a function of reducing small droplets and neutral particles, ions are eliminated by collision with the wall of the electrostatic lens 8 to thereby greatly reduce ion transmission efficiency to make it difficult finally to improve the signal-to-noise ratio greatly because ions are not focused at the portion of the electrostatic lens 8. If small droplets and neutral particles are narrowed just after the ion take-out aperture 7 of the differential pumping portion, small droplets and neutral particles may be spread spatially again so as to flow into the ion take-in aperture 12 of the mass analysis portion in the case where the distance between the ion take-out aperture 7 of the differential pumping portion and the ion take-in aperture 12 of the mass analysis portion is large. It is most effective that small droplets and neutral particles as the cause of noises are narrowed just before deflection of ions. Therefore, the slit 9 may be provided so as to be added to the focusing lens 8 as shown in FIG. 2 or may be provided in the inside of the electrostatic lens (or deflector) for deflecting ions.

Preferably, the slit 9 is an electrical conductor such as a metal, or the like, and the electric potential thereof is kept in a predetermined value. This is because the change of the electric potential of the slit 9 has influence on the orbit of ions. Accordingly, though not shown, the slit 9 is connected to the ground or an electric source. The electric potential of the slit 9 is kept in a value allowing ions to pass through the slit 9, that is, the electric potential of the slit 9 is kept lower than the electric potential of the ion take-out aperture 7 of the differential pumping portion for analysis of positive ions or kept higher than the electric potential of the ion take-out aperture 7 for analysis of negative ions.

Figure 4A:
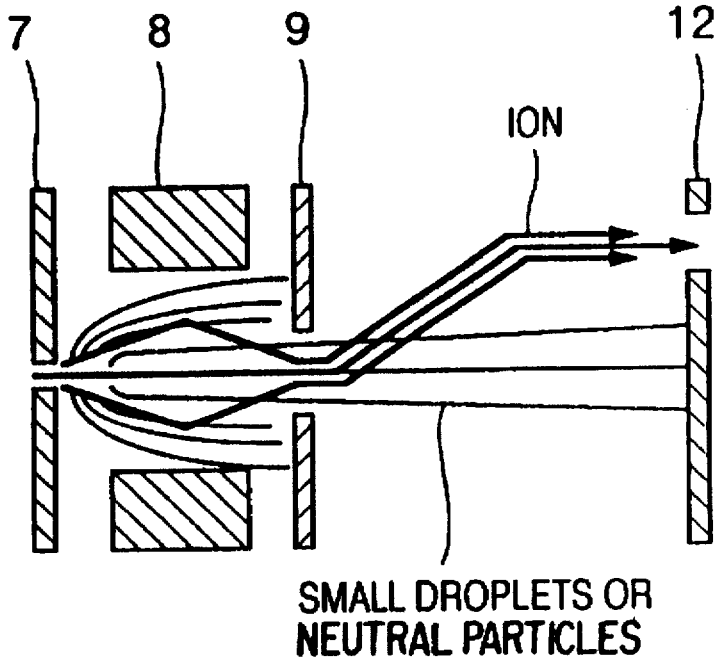
FIGS. 4A and 4B are conceptual views for explaining the meaning of the slit.
Figure 4B:
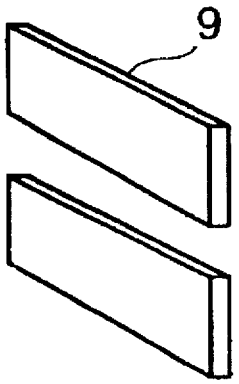
Figure 5A:
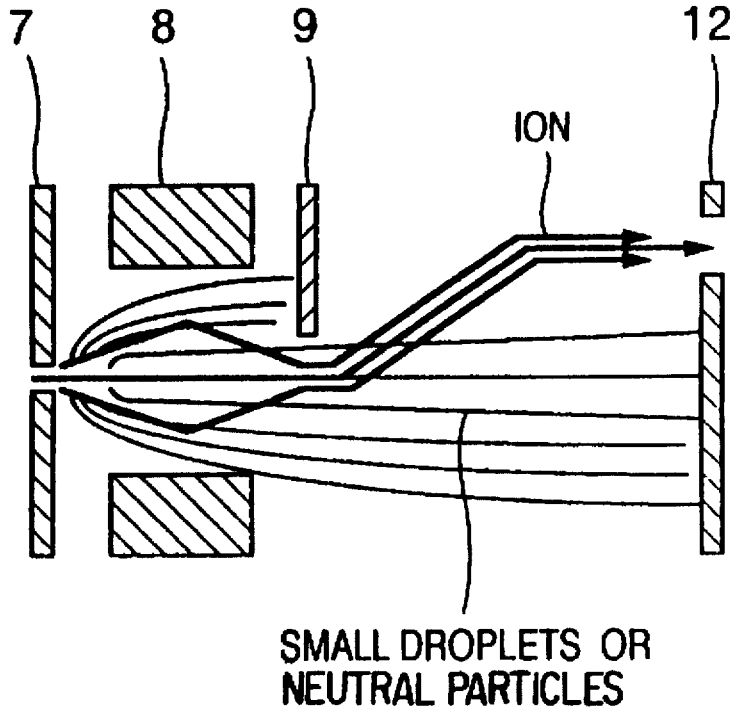
FIGS. 5A and 5B are conceptual views for explaining the meaning of the slit.
Figure 5B:
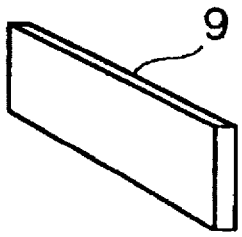
Figure 6:
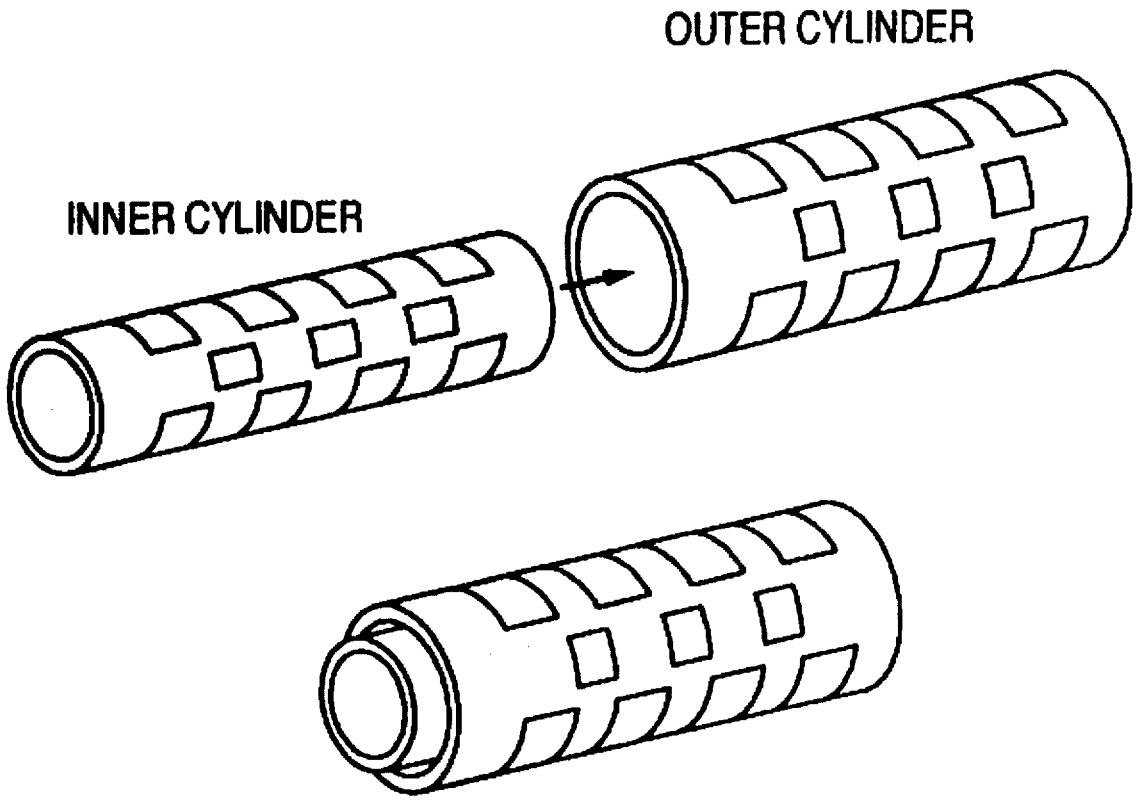
FIG. 6 is a schematic view of a double-cylindrical electrostatic lens.

Although the above description has been made upon the case where a plate having a circular hole is used for cutting droplets and neutral particles as the cause of noises, the same effect as described above arises also in the case where two plates are arranged as shown in FIGS. 4A and 4B or in the case where a plate is arranged in the deflecting side as shown in FIGS. 5A and 5B Ions which have passed through the slit 9 enter a double-cylindrical electrostatic lens having an inner cylindrical electrode 10 and an outer cylindrical electrode 11 each of which is provided with a large number of aperture portions (see FIG. 6). The electrostatic lens has a function of focusing ions simultaneously with deflection of ions and then introducing ions into the mass analysis portion. With respect to the sizes of the cylindrical electrodes in FIG. 1, the inner cylindrical electrode 10 has a length of about 100 mm and an inner diameter of about 18 mm (provided with three or four alignments of openings arranged so as to be in phase by 90°, each alignment containing four openings, each opening having a width of about 10 mm) and the outer cylindrical electrode 11 has a length of about 100 mm and an inner diameter of about 22 mm. In this occasion, the outer cylindrical electrode 11 is provided with a large number of evacuation aperture portions for evacuating the inside of an ion guide sufficiently. Ions deflected by about 4 mm with respect to the center axis of the ion take-out aperture 7 of the differential pumping portion are introduced into the mass analysis portion through the ion take-in aperture 12 of the mass analysis portion so as to be mass-analyzed and detected. FIG. 1 shows the case where a quadrupole mass analysis portion 13 is used. In such a detector, a voltage higher than the voltage applied to the inner cylindrical electrode is applied to the outer cylindrical electrode so that deflection is performed by using an electric field generated through the aperture portions of the inner cylindrical electrode.

FIG. 2 shows an example of voltage application in a region from the ion take-in aperture 6 to the quadrupole mass analysis portion. In the case of measurement of positive ions, a voltage in a range of from 130 to 250 V is applied to the ion take-in aperture 6, a fixed voltage of 130 V is applied to the ion take-out aperture 7, and voltages of 0 V, 90 V and 0 V are applied to the three electrodes of the electrostatic lens 8 in the order from left to right in the drawing. At this time, voltages of 460 V and −130 V are applied respectively to the outer cylindrical electrode and the inner cylindrical electrode which act to perform deflection. A shield case containing the mass analysis portion is electrically connected to the ground. In the case of measurement of negative ions, the polarities of voltages applied to the respective electrodes are inverted.

Further, an important meaning is in that the direction of deflection is set to be reverse to the direction of gravity. This is because, when extremely large droplets are introduced into a vacuum, the droplets fall down in a shape as they are in the direction of gravity. It is further important that a vacuum pump as a main evacuation system is arranged nearly under the lens so that the deflection portion can be evacuated efficiently. Generally, this region is evacuated in a range of from about $10^{-5}$ to about $10^{-6}$ Torr by a turbo molecular pump (evacuating rate: hundreds of liters per second). After ions are detected by a detector 14, the ion detection signal is amplified by an amplifier 15 and transferred to a data processor 16. Generally, the ion detection signal is outputted in the form of a mass spectrum or chromatogram.

Figure 7:
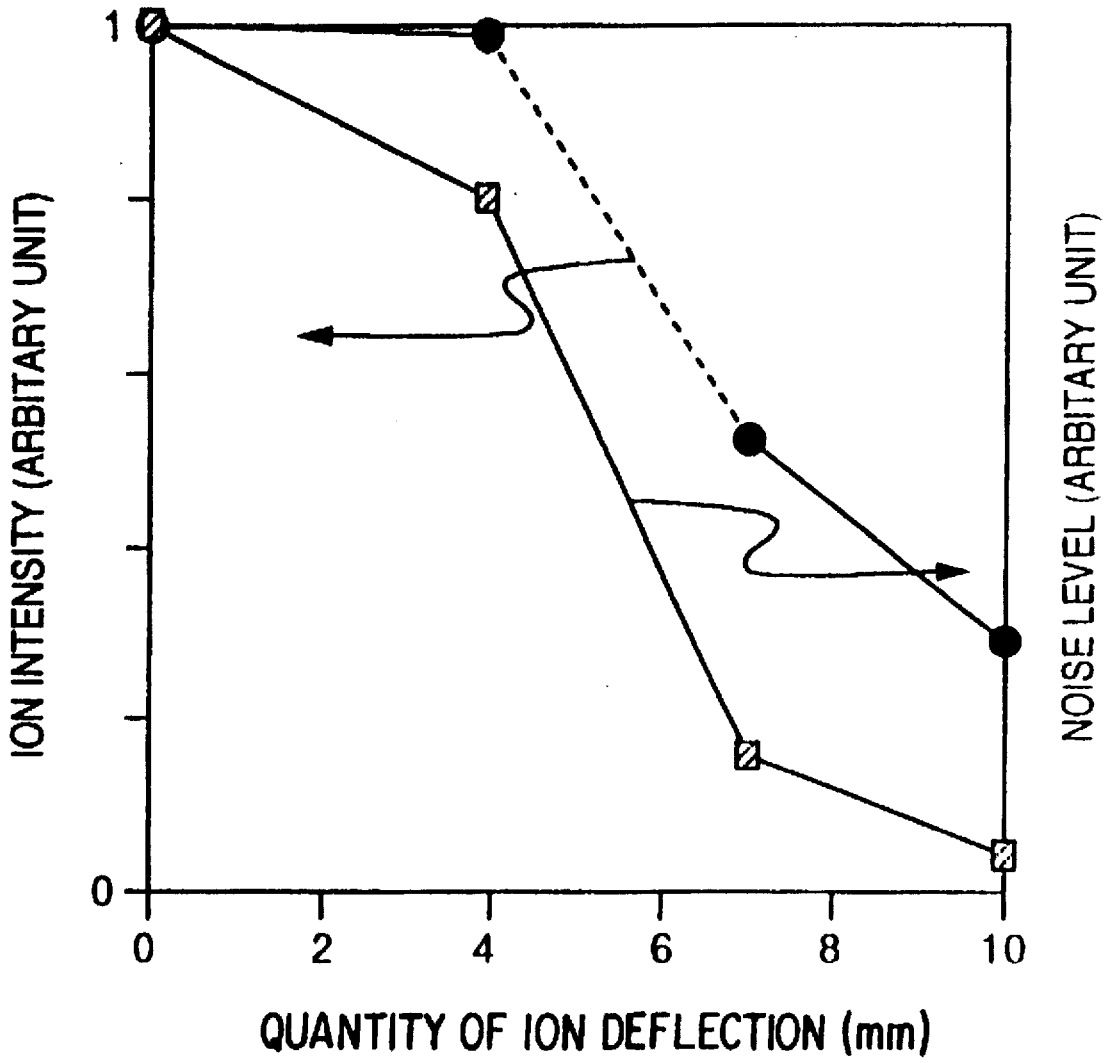
FIG. 7 is a graph showing the relation between the quantity of ion deflection and ion intensity and the relation between the quantity of ion deflection and the noise level in the case where no slit is provided.
Figure 8:
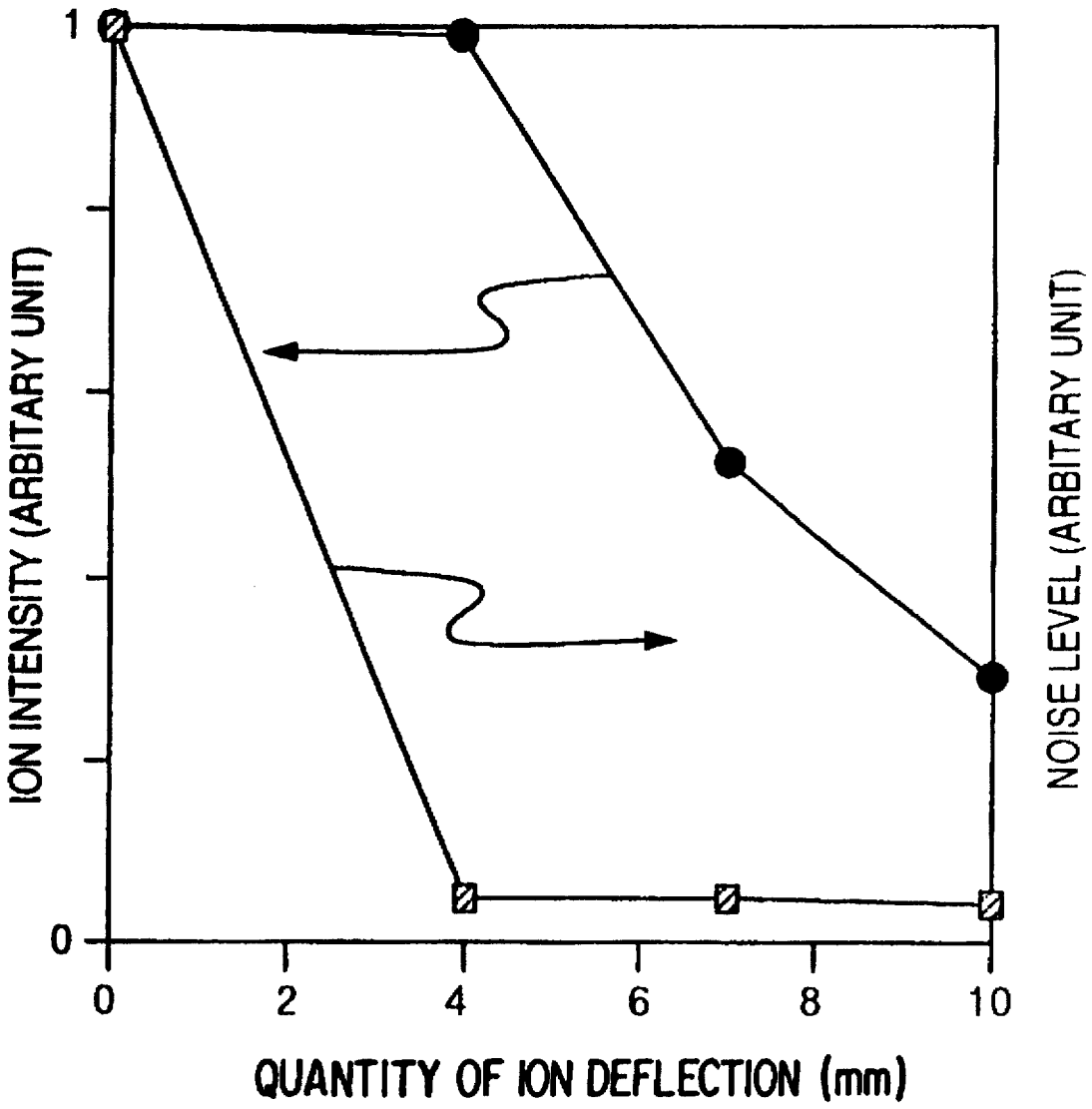
FIG. 8 is a graph showing the relation between the quantity of ion deflection and ion intensity and the relation between the quantity of ion deflection and the noise level in the case where a slit is provided.

FIG. 7 shows the relation between the ion intensity and the quantity of ion deflection in a range from the ion take-out aperture 7 of the differential pumping portion to the ion take-in aperture 12 of the mass analysis portion in the double-cylindrical deflection lens described preliminarily in the case where no slit is provided. In this occasion, the ion intensity is normalized by a value in the case where the quantity of deflection is 0 mm. It is apparent from this result that the lowering of ion intensity is little when the quantity of deflection is not larger than 4 mm. It is, however, apparent that ion intensity is lowered to about ½ or ⅓ when the quantity of deflection is increased to 7 mm or 10 mm, respectively. FIG. 7 shows the relation between the noise level (a value obtained by adding noises in a range of from 100 to 150 to the value of mass/charge on the measured mass spectrum) and the quantity of deflection in the case where no slit is provided. In this occasion, the noise level is normalized by a value in the case where the quantity of deflection is 0 mm. It is apparent that the noise level is reduced greatly when the quantity of deflection is increased to 7 mm or 10 mm compared with the case where the quantity of defection is 0 mm or 4 mm. On the other hand, FIG. 8 shows results in the case where a slit is provided in the preliminarily described condition. It is apparent that the lowering of the noise level cannot be expected when the quantity of deflection is 0 mm but the noise level is reduced to about 1/10 as much as the noise level in the case where no slit is provided when the quantity of deflection is 4 mm. Furthermore, there is little reduction of ion intensity. The aforementioned results show that noises can be reduced greatly without reduction of signals to thereby finally make it possible to improve the signal-to-noise ratio greatly by systematically combining the two techniques, by means of a slit, for cutting a large part of small droplets and neutral particles flowing-in through the ion take-in aperture of the differential pumping portion, and for deflecting ions selectively slightly.

Figure 9A:
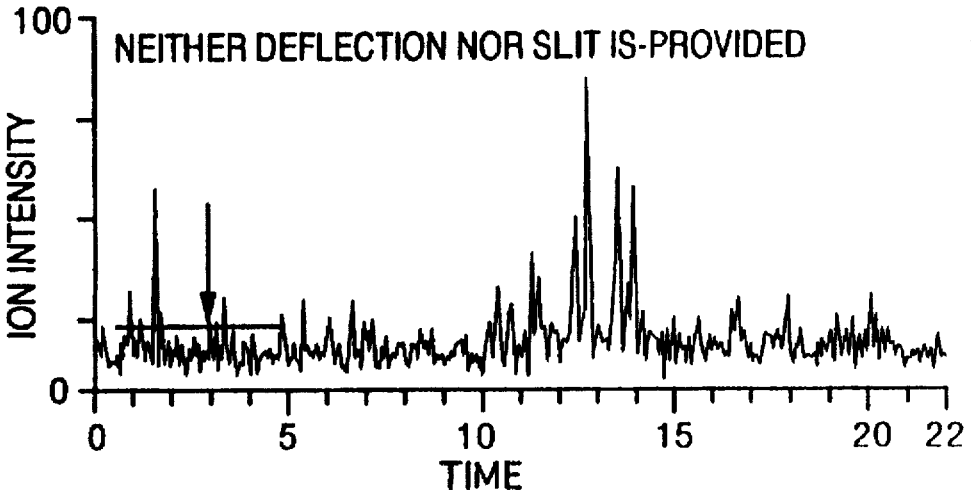
FIG. 9A and 9B are graphs of the total ion chromatogram of steroids showing an effect of the present invention.
Figure 9B:
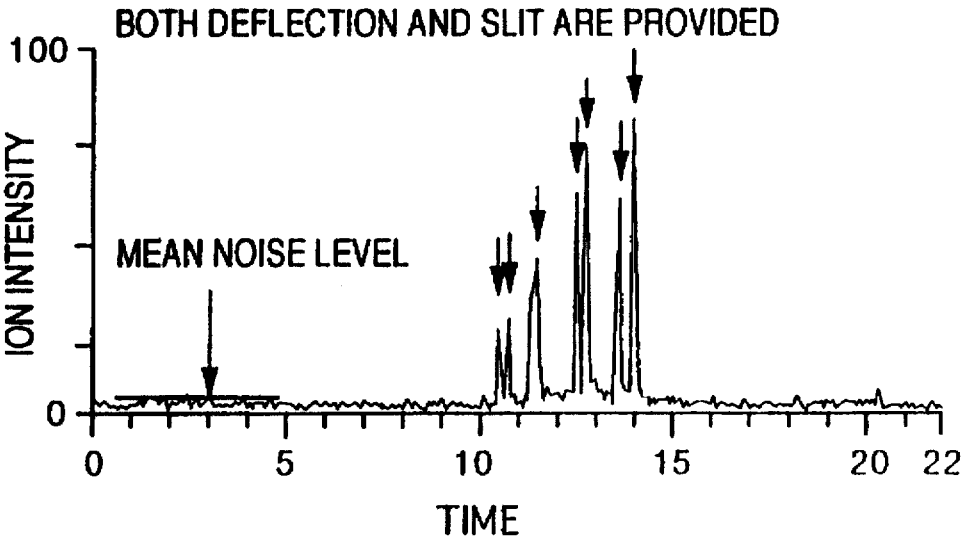

Upon the aforementioned results, data of a liquid chromatograph/mass spectrometer is obtained in practice. FIGS. 9A and 9B show comparison between a total ion chromatogram in the case where an atmospheric pressure chemical ionization method is employed in an ion source in a conventional apparatus and a total ion chromatogram in the case where the same method is employed in an ion source in an apparatus according to the present invention. Arrows indicate sample positions. Steroids are used as samples. The total ion chromatogram herein used means a result of observation of the change with the passage of time, of a value obtained by adding up ion intensity on mass spectra obtained by repeatedly scanning a certain mass range. Accordingly, if there is any sample, ions concerning the sample are observed. The measurement condition used herein was as follows. As the mobile phase for the liquid chromatograph for separation, A: water and B: methanol were used. A gradient analysis mode was used in which a state of 90% A and 10% B was changed to a state of 100% B in 10 minutes. As the samples used were 8 kinds of samples, namely, cortisone, cortisol, cortisol acetate, corticosterone, testosterone, methyltestosterone, testosterone acetate, and testosterone propionate. The quantity of each sample was about 140 pmol. In the case where, there is neither ion deflection nor provision of any slit, in spite of the fact that seven components are separated by the liquid chromatograph, three of the seven components cannot be clearly recognized because of high noises. In the case of an apparatus according to the present invention, that is, in the case where not only ions were deflected but also a slit was provided, however, all the seven components introduced could be clearly detected because of great reduction of noises though the same quantity of the sample was introduced. It is further apparent that the signal-to-noise ratio is finally improved by 5 times or more because the noise level is reduced greatly to ⅕ times or less while the signal intensity is not reduced.

Figure 10:
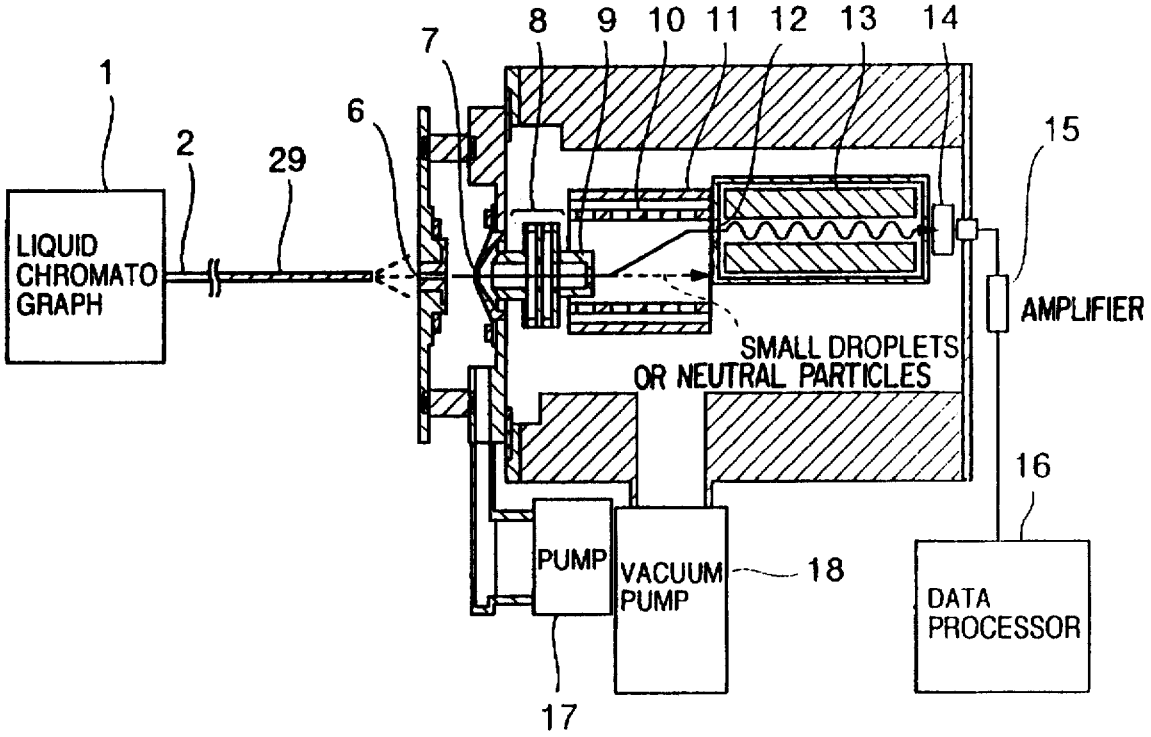
FIG. 10 is a structural view of an apparatus showing an embodiment of the present invention using an electrostatic spraying method.
Figure 11A:
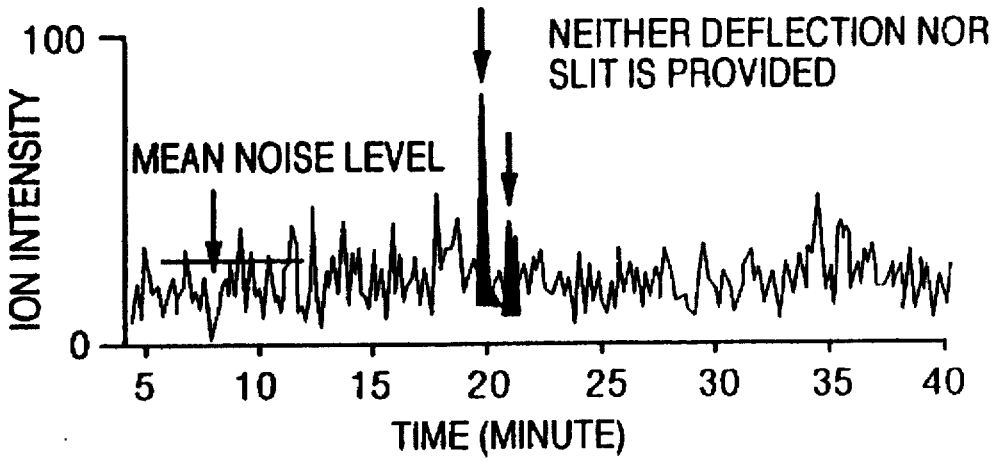
FIG. 11A and lib are graphs of the total ion chromatogram of peptides showing an effect of the present invention.
Figure 11B:
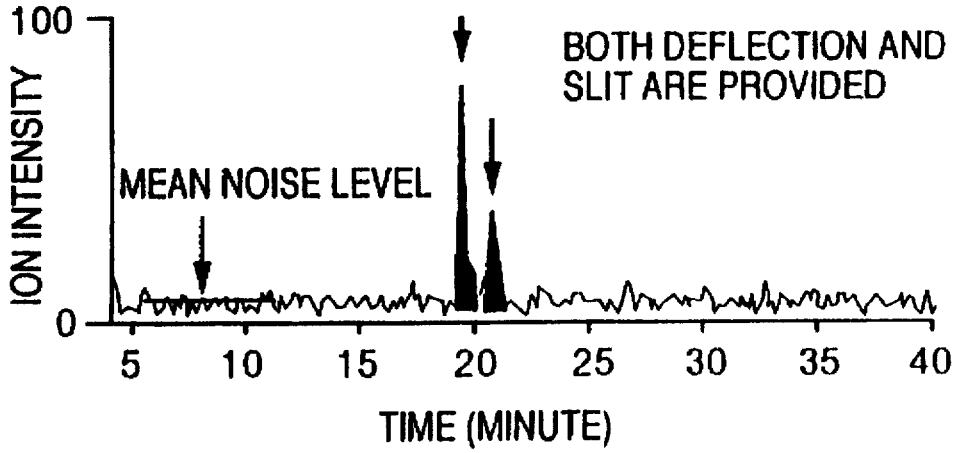

The following example shows the case where an electrospray method as a kind of atmospheric pressure ionization method is used. FIG. 10 is a structural view of an apparatus using this method. In this method, a sample solution eluted from the liquid chromatograph 1 is first introduced into a metal capillary 29. If a high voltage is applied between the metal capillary 29 and an electrode having an ion take-in aperture 6 and being opposite to the metal capillary 29, the sample solution is electrostatically sprayed from a forward end of the metal capillary 29. Droplets containing ions generated at this time are introduced through the ion take-in aperture 6. The other apparatus configuration and measurement principle are the same as those in FIG. 1. FIGS. 11A and lib show results of total ion chromatograms obtained by a liquid chromatograph/mass spectrometer using the electrospray method. Arrows indicate sample positions. As samples used were about 70 pmol of angiotensin I and about 70 pmol of angiotensin II. The measurement condition used herein was as follows. As the mobile phase for the liquid chromatograph for separation, A: 0.1% TFA, 90% water and 10% methanol and B: 0.1% TFA, 40% water and 60% methanol were used. A gradient analysis mode was used in which a state of 100% A was changed to a state of 100% B in 30 minutes. From comparison between the case where the present invention is used and the case where the present invention is not used, it is apparent that the noise level is reduced greatly to ⅕ or less though the signal intensity of angiotensin I and angiotensin II are not changed. That is, the signal-to-noise ratio was improved to 5 times or more by the use of the present invention.

Although the above description has been made about the case where a liquid chromatograph/mass spectrometer is mainly used for analysis of an organic compound, the same effect as described above is attained also in the case of a capillary electrophoresis system/mass spectrometer.

Further, the present invention is effective in the case of a plasma mass spectrometer in which ions generated by ionizing a metal, or the like, in a solution by plasma are detected by a mass spectrometer. In this case, photons generated from plasma as well as small droplets and neutral particles are a main cause of noises in the detector. The combination of the provision of a slit and the slight deflection of ions according to the present invention is very effective also for removing such photons.

Figure 12:
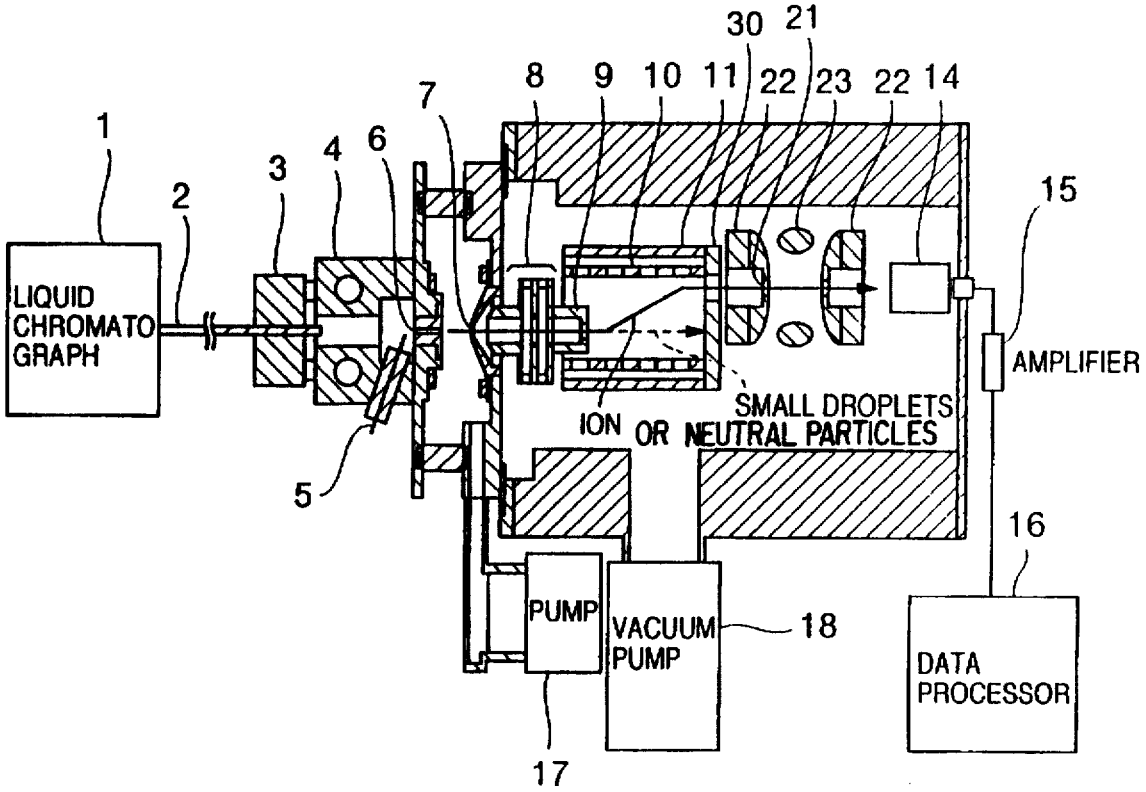
FIG. 12 is a structural view of an apparatus 5 showing an embodiment of the present invention.

Although the previous example has been described about the case where a quadrupole mass analysis portion 13 is used as the mass analysis portion, the same effect as described above can be expected also in the case where another mass spectrometer such as an ion trap mass spectrometer, or the like, is used in place of the quadrupole mass analysis portion 13. FIG. 12 shows an example of the ion trap mass spectrometer. The ion trap mass spectrometer is a mass spectrometer constituted by a pair of cup-like end cap electrodes 22 and a ring electrode 23 disposed between the pair of end cap electrodes 22. The ion trap mass spectrometer uses a high-frequency electric field to perform mass analysis.

Figure 19:
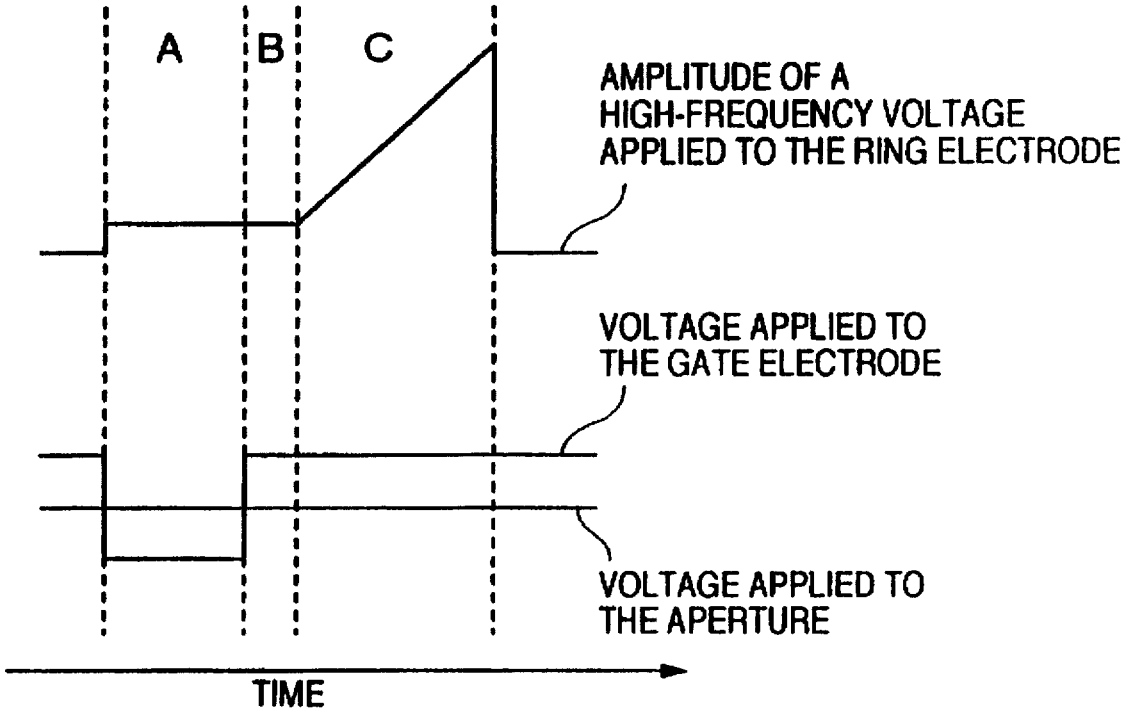
FIG. 19 is a graph showing voltages applied to a ring electrode and a gate electrode respectively in an ion trap mass spectrometer.

The operation of the ion trap mass spectrometer in the case of analysis of positive ions will be described below. A voltage to be applied to the ring electrode 23 and a voltage to be applied to a gate electrode 30 for controlling introduction of ions into the mass analysis portion and performing shielding to prevent the high-frequency electric field of the mass analysis portion from having influence on the electric field of the electrostatic lens are controlled by a controller not shown. FIG. 19 shows the amplitude of the high-frequency electric voltage applied to the ring electrode 23 and the voltage applied to the gate electrode 30. In the condition in which a high-frequency voltage is applied to the ring electrode 23 in order to enclose ions and in which a voltage lower than the voltage of the ion take-out aperture 7 of the differential pumping portion is applied to the gate electrode 30, ions pass through the gate electrode 30 so that ions are introduced into the ion trap region and enclosed in the ion trap region (A in FIG. 19). When a voltage higher than the voltage of the ion take-out aperture 7 of the differential pumping portion is then applied to the gate electrode 30 while a high-frequency voltage is continuously applied to the ring electrode 23 to enclose ions, ions cannot pass through the gate electrode 30 so that the flowing of ions into the ion trap region (the ion trap mass analysis region) stops. Because the inside of the ion trap region is filled with a helium gas having a predetermined pressure, the kinetic energy of the ions enclosed in the ion trap region is lost by collision of the ions with the helium gas, so that the ions are concentrated into the center portion of the ion trap region which is low in potential (B in FIG. 19). If the amplitude of the high-frequency voltage applied to the ring electrode 23 increased gradually, the orbits of ions are made unstable in the ascending order of the value obtained by dividing the mass of the respective ion by the electric charge thereof, so that the ions are withdrawn out of the ion trap region (C in FIG. 19).

Also in this case, the combination of removal of small droplets and neutral particles by means of a slit and slight deflection of ions through the gate electrode 30 for controlling introduction of ions into the ion trap mass analysis portion and for eliminating the influence of the high-frequency electric field from the ion trap mass analysis portion before introduction of ions into the ion take-in aperture 21 of the end cap electrode located in the ion source side greatly contributes to reduction of noises. Particularly in the case of the ion trap mass spectrometer, the present invention is more effective than the case of the quadrupole mass spectrometer. In the quadrupole mass spectrometer, the ion take-in aperture 12 of the mass analysis portion has a relatively large diameter of about 3 mm. Accordingly, reduction of ion transmission efficiency is not so great even in the case where the focusing condition at the ion take-in aperture 12 of the mass analysis portion is poor, that is, even in the case where the ion beam is spread at this portion. In the ion trap mass spectrometer, however, the ion take-in aperture provided in the end cap electrode cannot be made so large in order to prevent increase of the disturbance of the high-frequency electric field in the inside. Generally, the diameter of the ion take-in aperture is set to about 1.3 mm which is smaller than that in the case of the quadrupole mass spectrometer. Accordingly, in the ion trap mass spectrometer, when ions are deflected in the conventional manner, the lowering of ion transmission efficiency becomes remarkable because the focusing condition at the ion take-in aperture is poor if the ion beam is spread at the ion take-in aperture. From this point of view, it is also very effective that the present invention is applied to the ion trap mass spectrometer.

Figure 13:
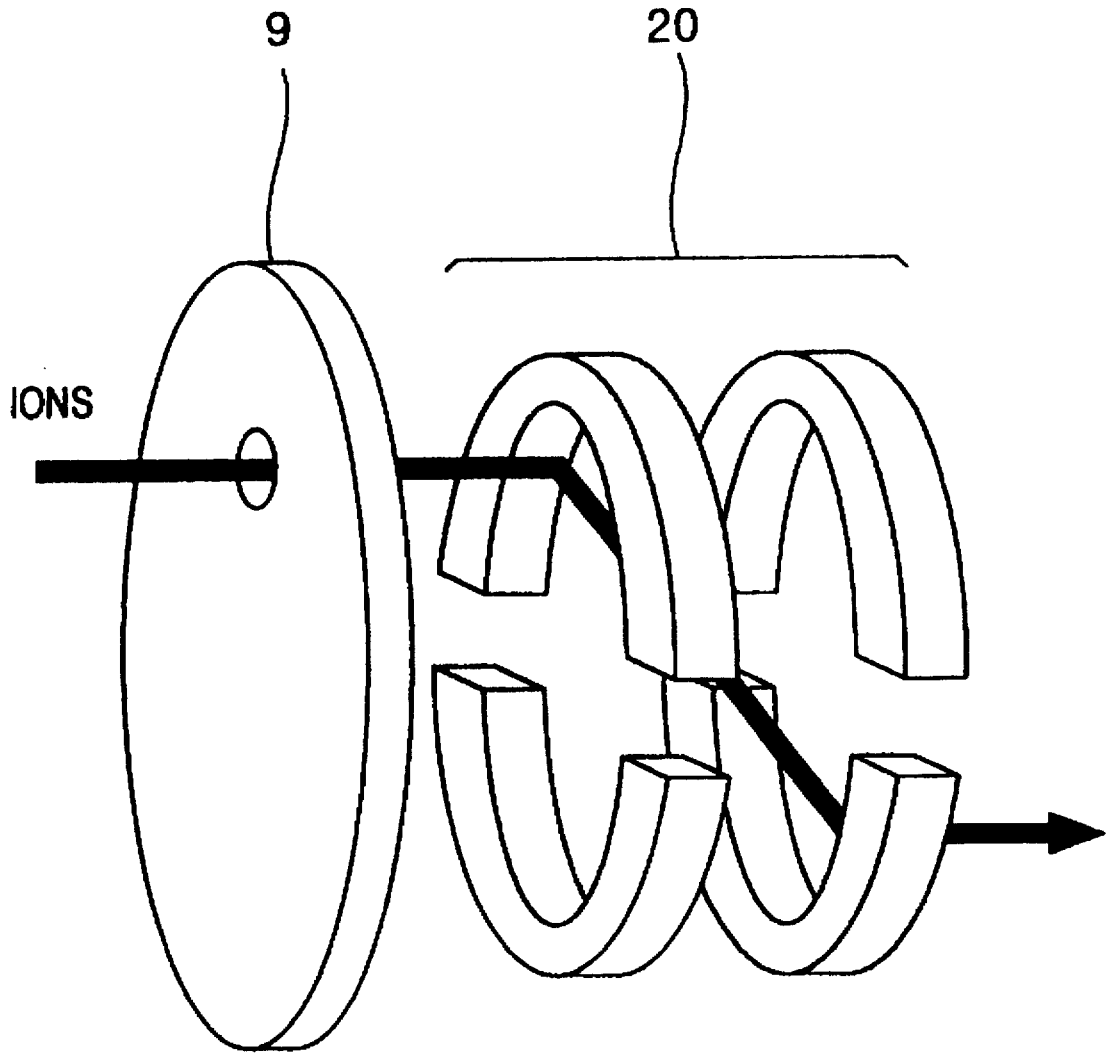
FIG. 13 is a structural view of an apparatus showing an embodiment of the present invention.
Figure 14:
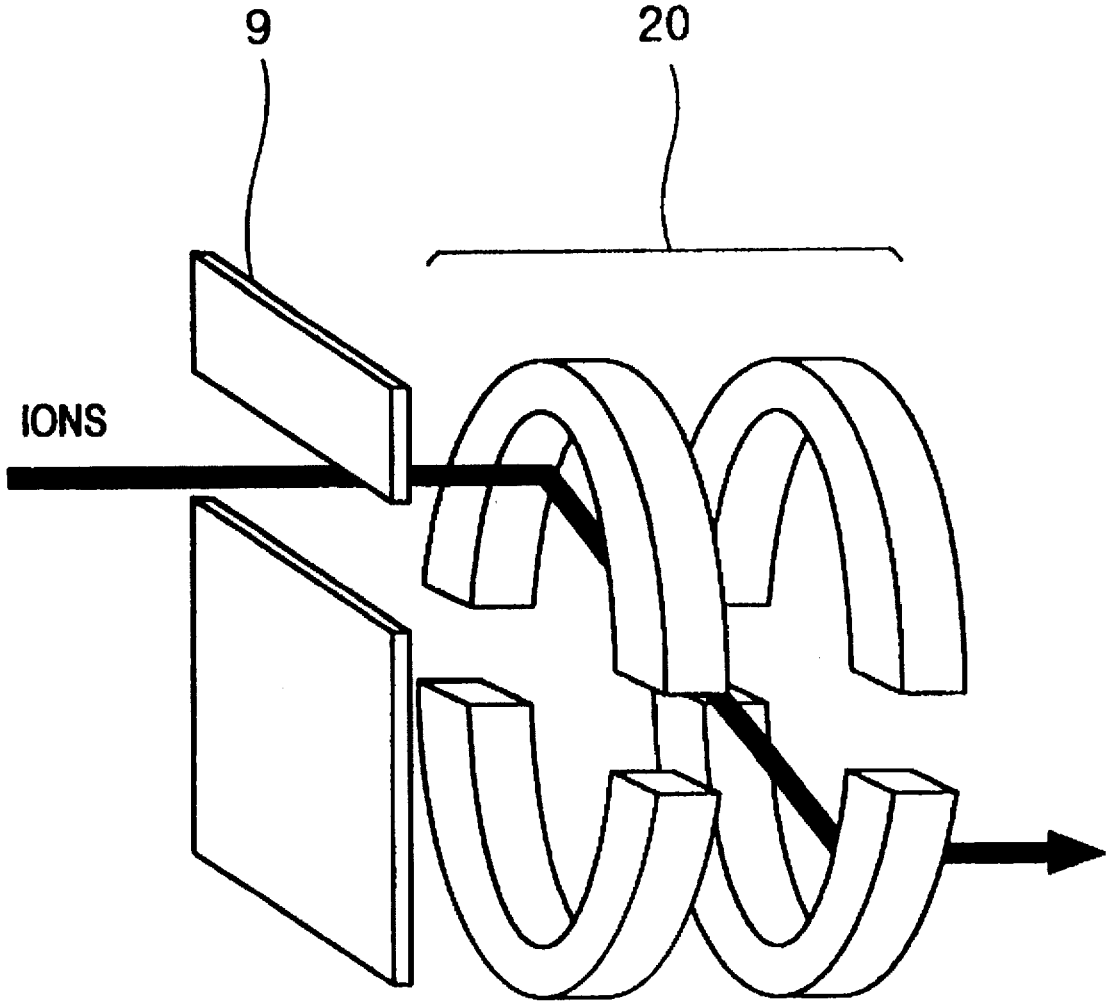
FIG. 14 is a structural view of an apparatus showing an embodiment of the present invention.
Figure 15:
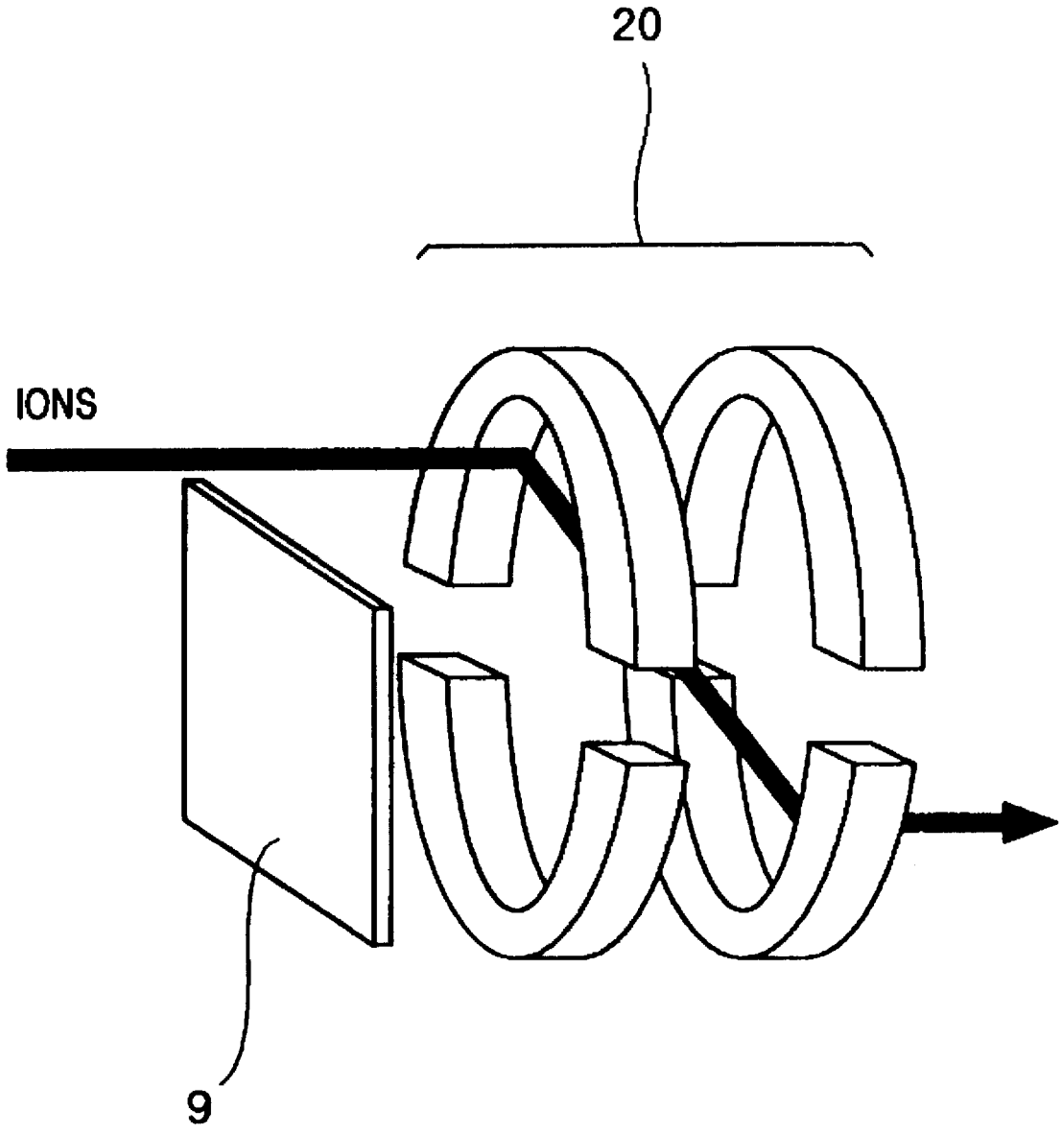
FIG. 15 is a structural view of an apparatus showing an embodiment of the present invention.
Figure 16:
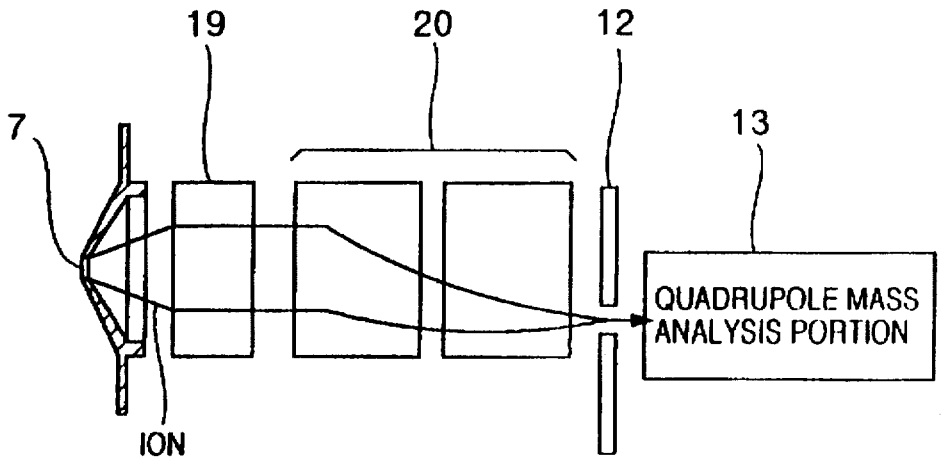
FIG.16 PRIOR ART
FIG. 16 is a structural view of a conventional apparatus.
Figure 17:
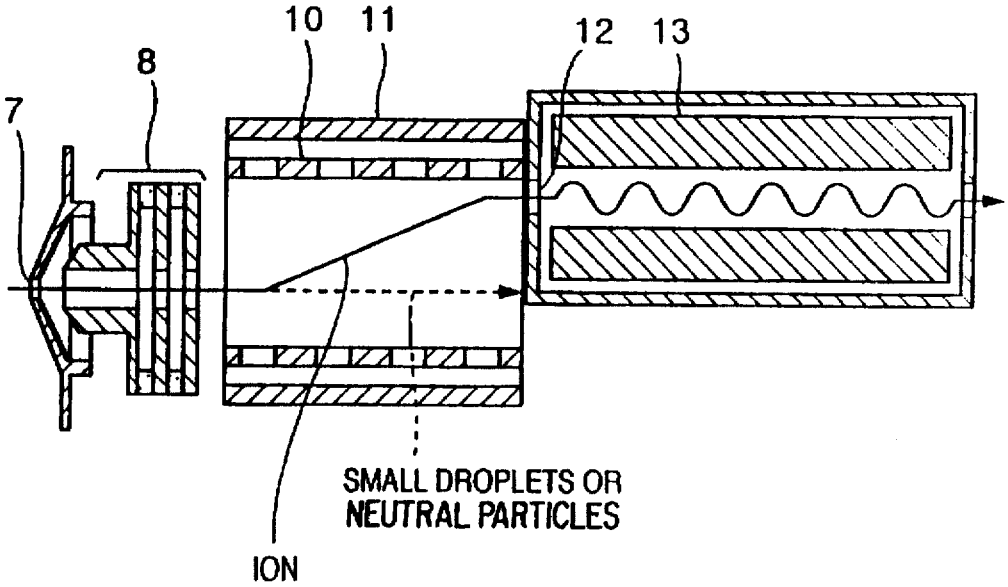
FIG.17 PRIOR ART
FIG. 17 is a structural view of a conventional apparatus.
Figure 18:
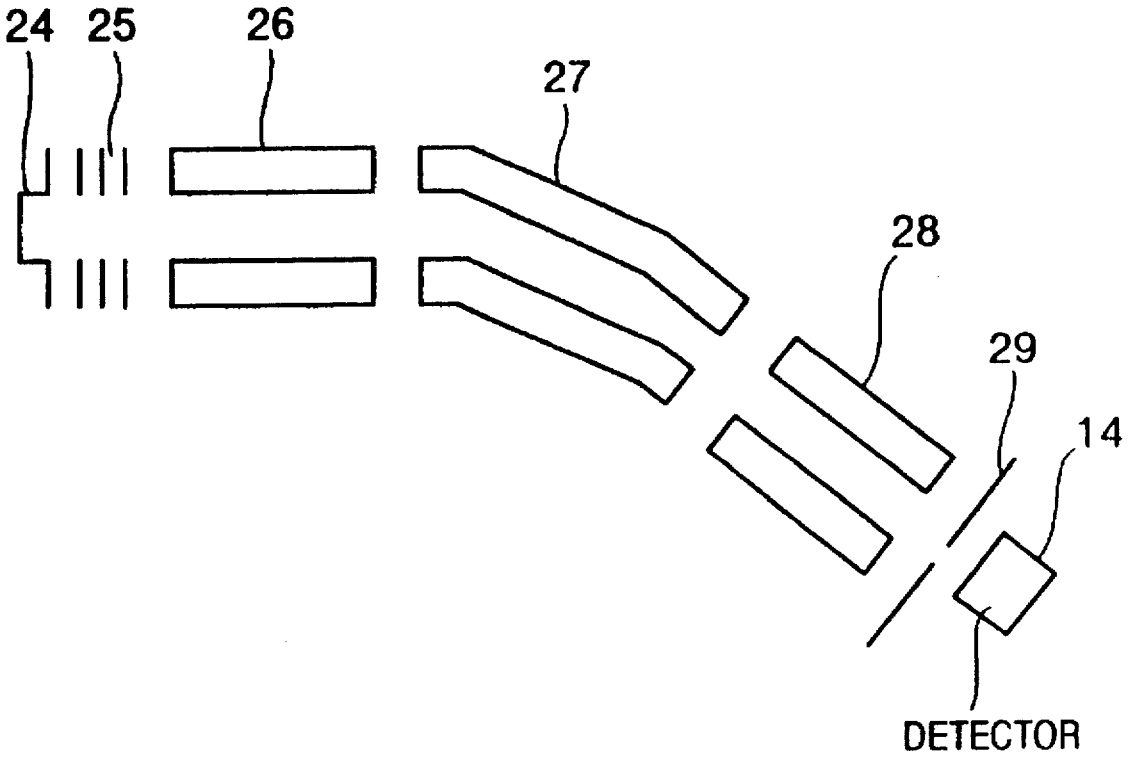
FIG.18 PRIOR ART
FIG. 18 is a structural view of a conventional apparatus.

Although the above description has been made about the case where a double-cylindrical electrostatic lens is used for deflecting and focusing ions, it is also effective to combine the slit 9 with such a type of deflector 20 as disclosed in U.S. Pat. No. 4,999,492 and as shown in FIG. 13. The deflector 20 disclosed therein has such a shape as shown in FIG. 13. If a slit is provided in front of the deflector of this type, the same effect as in the case of the double-cylindrical electrostatic lens is attained. Also in this case, an example shown in FIG. 14 (in which a slit is formed by two plates) and an example shown in FIG. 15 (in which a slit is formed by a plate provided in the direction of deflection) are thought of. When deflectors of the types shown in FIGS. 13 to 15 are designed in practice, however, it becomes clear that the following problem arises. That is, in these deflectors, electric fields for deflecting ions are generated correspondingly to the electric potentials applied to the electrodes but the electric fields generated from the respective electrodes interfere with each other to form a complex electric field distribution because the respective electrodes are not shielded from each other. Accordingly, the effect of interference between electric fields must be discussed in order to produce a deflector which is high in ion transmission efficiency. It is however difficult to grasp the effect of interference accurately in a deflector using a plurality of electrodes each having a complex shape. In the double-cylindrical electrostatic lens shown in FIG. 2, ions are deflected and focused by electric fields penetrating into the inner cylindrical electrode through the aperture portions provided in the inner cylindrical electrode but the electric fields penetrating into the inner cylindrical electrode through the aperture portions do not interfere with each other because the aperture portions are independent of each other. Accordingly, the double-cylindrical electrostatic lens is superior to the conventional deflector in that the effect of deflecting and focusing the ion beam can be predicted easily in the case of the double-cylindrical electrostatic lens.

According to the above embodiments of the present invention, the mass spectrometer comprises an ionization portion for generating electrically charged droplets or ions from a sample solution under atmospheric pressure or similar pressure, a differential pumping portion for introducing electrically charged droplets or ions into a mass analysis portion under a high vacuum, and a mass analysis portion for taking-in ions and performing mass analysis, detection and data processing, whereby noises are reduced greatly without reducing signals to thereby greatly improve the signal-to-noise ratio as an index of detecting sensitivity (lower limit) by combination of cutting of small droplets, neutral particles or photons through a slit provided between the differential pumping portion and the mass analysis portion, with slight deflection of ions just before introduction of ions into the mass analysis portion.

What is claimed is:

1. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector.

2. An apparatus for mass analysis according to claim 1, wherein said limit plate is disposed so as to be added to said focusing lens.

3. An apparatus for mass analysis according to claim 1, wherein said limit plate is disposed in the inside of said deflector.

4. An apparatus for mass analysis according to claim 1, wherein said limit plate is provided in a position of a focal point of said focusing lens.

5. An apparatus for mass analysis according to claim 1, wherein said limit plate is a metal plate having an opening portion.

6. An apparatus for mass analysis according to claim 5, wherein said opening portion is shaped like a circle having an inner diameter in a range of from 0.5 mm to 5 mm.

7. An apparatus for mass analysis according to claim 1, wherein said limit plate is constituted by at least one metal plate.

8. An apparatus for mass analysis according to claim 1, wherein said mass spectrometer is of a quadrupole type.

9. An apparatus for mass analysis according to claim 1, wherein said deflector deflects said electrically charged particles in a direction different from the direction of gravity.

10. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said mass spectrometer is of an ion trap type.

11. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said deflector is an electrostatic lens having an effect of focusing said electrically charged particles.

12. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes.

13. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes, said outer electrode having an opening portion for evacuating the inside of said inner electrode.

14. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector.

15. An apparatus for mass analysis according to claim 14, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes.

16. An apparatus for mass analysis according to claim 14, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes, said outer electrode having an opening portion for evacuating the inside of said inner electrode.

17. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is disposed so as to be added to said focusing lens.

18. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is disposed in the inside of said deflector.

19. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is provided in a position of a focal point of said focusing lens.

20. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is a metal plate having an opening portion.

21. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is a metal plate having an opening portion; and wherein said opening portion is shaped like a circle having an inner diameter in a range of from 0.5 mm to 5 mm.

22. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said limit plate is constituted by at least one metal plate.

23. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said deflector deflects said electrically charged particles in a direction different from the direction of gravity.

24. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

an ion trap mass spectrometer for measuring physical quantities of said electrically charged particles deflected by said deflector;

wherein said deflector is an electrostatic lens having an effect of focusing said electrically charged particles.

25. An apparatus for liquid chromatography/mass spectrometry comprising:

a liquid chromatograph for separating a matter contained in a sample in solution;

at least one of a nebulizer and vaporizer for nebulizing and/or vaporizing the sample solution obtained from said liquid chromatograph;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector.

26. An apparatus for liquid chromatography/mass spectrometry according to claim 25, wherein said limit plate is disposed so as to be added to said focusing lens.

27. An apparatus for mass analysis according to claim 25, wherein said limit plate is disposed in the inside of said deflector.

28. An apparatus for liquid chromatography/mass spectrometry according to claim 25, wherein said limit plate is provided in a position of the focal point of said focusing lens.

29. An apparatus for liquid chromatography/mass spectrometry according to claim 25, wherein said limit plate is a metal plate having an opening portion.

30. An apparatus for liquid chromatography/mass spectrometry according to claim 29, wherein said opening portion is shaped like a circle having an inner diameter in a range of from 0.5 mm to 5 mm.

31. An apparatus for liquid chromatography/mass spectrometry according to claim 25, wherein said limit plate is constituted by at least one metal plate.

32. An apparatus for liquid chromatography/mass spectrometry according to claim 25, wherein said spectrometer is of a quadrupole type.

33. An apparatus for liquid chromatography/mass spectrometry according to claim 25, wherein said deflector deflects said electrically charged particles in a direction different from the direction of gravity.

34. An apparatus for liquid chromatography/mass spectrometry according to claim 25, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes.

35. An apparatus for liquid chromatography/mass spectrometry according to claim 25, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes, said outer electrode having an opening portion for evacuating the inside of said inner electrode.

36. An apparatus for liquid chromatography/mass spectrometry comprising:

a liquid chromatograph for separating a matter contained in a sample in solution;

at least one of a nebulizer and vaporizer for nebulizing and/or vaporizing the sample solution obtained from said liquid chromatograph;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said mass spectrometer is of an ion trap type.

37. An apparatus for liquid chromatography/mass spectrometry comprising:

a liquid chromatograph for separating a matter contained in a sample in solution;

at least one of a nebulizer and vaporizer for nebulizing and/or vaporizing the sample solution obtained from said liquid chromatograph;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said deflector is an electrostatic lens having an effect of focusing said electrically charged particles.

38. An apparatus for capillary electrophoresis/mass spectrometry comprising:

a capillary electrophoresis unit for separating a matter contained in a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector.

39. An apparatus for capillary electrophoresis/mass spectrometry according to claim 38, wherein said limit plate is disposed so as to be added to said focusing lens.

40. An apparatus for capillary electrophoresis/mass spectrometry according to claim 38, wherein said limit plate is disposed in the inside of said deflector.

41. An apparatus for capillary electrophoresis/mass spectrometry according to claim 38, wherein said limit plate is provided in a position of the focal point of said focusing lens.

42. An apparatus for capillary electrophoresis/mass spectrometry according to claim 38, wherein said limit plate is a metal plate having an opening portion.

43. An apparatus for capillary electrophoresis/mass spectrometry according to claim 42, wherein said opening portion is shaped like a circle having an inner diameter in a range of from 0.5 mm to 5 mm.

44. An apparatus for capillary electrophoresis/mass spectrometry according to claim 38, wherein said limit plate is constituted by at least one metal plate.

45. An apparatus for capillary electrophoresis/mass spectrometry according to claim 38, wherein said mass spectrometer is of a quadrupole type.

46. An apparatus for capillary electrophoresis/mass spectrometry according to claim 38, wherein said deflector deflects said electrically charged particles in a direction different from the direction of gravity.

47. An apparatus for capillary electrophoresis/mass spectrometry according to claim 38, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes.

48. An apparatus for capillary electrophoresis/mass spectrometry according to claim 38, wherein: said deflector is an electrostatic lens having an effect of focusing said electrically charged particles, said electrostatic lens being composed of a cylindrical inner electrode, and an outer electrode arranged in the outside of said inner electrode, said inner electrode having an opening portion through which an electric field of said outer electrode passes, said outer electrode having an opening portion for evacuating the inside of said inner electrode.

49. An apparatus for capillary electrophoresis/mass spectrometry comprising:

a capillary electrophoresis unit for separating a matter contained in a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said mass spectrometer is of an ion trap type.

50. An apparatus for capillary electrophoresis/mass spectrometry comprising:

a capillary electrophoresis unit for separating a matter contained in a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens;

a deflector for deflecting said required particle stream passed through said limit plate;

a mass spectrometer for measuring physical quantities of said electrically charged particles deflected by said deflector;

wherein said deflector is an electrostatic lens having an effect of focusing said electrically charged particles.

51. An apparatus for mass analysis comprising: a sample supply unit for supplying a sample in solution; at least one of a nebulizer and vaporizer for nebulizing and/or vaporizing the sample solution; an ion generator for ionizing a predetermined matter in the nebulized or vaporized sample solution to thereby form a particle stream constituted by electrically charged particles and neutral particles; a differential pumping portion including an aperture for leading said particle stream to a vacuum analysis portion, and an electric source for applying a voltage to said aperture; a focusing lens for focusing said electrically charged particles contained in said particle stream; a deflector for deflecting said electrically charged particles; an ion trap mass spectrometer for measuring physical quantities of the deflected electrically charged particles; a limit plate for limiting a flow path of said particle stream, said limit plate being provided between said focusing lens and said ion trap mass spectrometer; and a gate electrode for controlling said electrically charged particles, said gate electrode being provided between said deflector and said ion trap mass spectrometer.

52. An apparatus for mass analysis according to claim 51, wherein said limit plate is disposed so as to be added to said focusing lens.

53. An apparatus for mass analysis according to claim 51, wherein said limit plate is disposed in the inside of said deflector.

54. An apparatus for mass analysis comprising:

a sample supply unit for supplying a sample in solution;

at least one of a nebulizer and vaporizer for nebulizing and/or vaporizing the sample solution;

an ion generator for ionizing a predetermined matter in the nebulized or vaporized sample solution to thereby form a particle stream constituted by electrically charged particles and neutral particles;

a differential pumping portion including an aperture for leading said particle stream to a vacuum analysis portion, and an electric source for applying a voltage to said aperture;

a focusing lens for focusing said electrically charged particles contained in said particle stream;

a limit plate for passing a required particle stream of a particle stream dispersed from said focusing lens, said limit plate being supplied with a predetermined voltage;

a deflector for deflecting said required particle stream passed through said limit plate;

a mass spectrometer for measuring physical quantities of said electrically charged particles deflected by said deflector.

55. An apparatus for mass analysis according to claim 54, wherein said limit plate is disposed so as to be added to said focusing lens.

56. An apparatus for mass analysis according to claim 54, wherein said limit plate is disposed in the inside of said deflector.

57. An apparatus for mass analysis comprising:

an ion source for ionizing a predetermined matter in a sample solution;

an electrostatic lens for deflecting and focusing ions of said predetermined matter;

a limit plate for limiting a flow path before deflection of said ions; and a mass spectrometer for mass-analyzing said ions.

58. An apparatus for mass analysis comprising:

an ion source for ionizing a predetermined matter in a sample solution;

an electrostatic lens for deflecting and focusing ions of said predetermined matter;

a limit plate for limiting a flow path before deflection of said ions; and a mass spectrometer for mass-analyzing said ions;

wherein said ion source includes an ion source for ionizing said predetermined matter by plasma.

59. An apparatus for mass analysis comprising:

an ion source for ionizing a predetermined matter in a sample solution;

an electrostatic lens for deflecting and focusing ions of said predetermined matter;

a limit plate for limiting a flow path before deflection of said ions; and a mass spectrometer for mass-analyzing said ions;

wherein said ion source includes an ion source for ionizing said predetermined matter by a chemical reaction.

60. An apparatus for mass analysis comprising:

an ion source for ionizing a predetermined matter in a sample solution;

an electrostatic lens for deflecting and focusing ions of said predetermined matter;

a limit plate for limiting a flow path before deflection of said ions; and a mass spectrometer for mass-analyzing said ions;

wherein said ion source includes an ion source for ionizing said predetermined matter by nebulizing or vaporizing said sample solution.

61. An apparatus for mass analysis comprising: an ion generator for ionizing a sample; an electrostatic lens for deflecting and focusing generated ions of said sample; a limit plate for limiting a flow path of said ions; and a mass spectrometer for mass-analyzing said ions.

62. A method for analysis comprising the steps of: ionizing a sample; deflecting and focusing ions of said sample by using an electrostatic lens; limiting a flow path before deflection of said ions; and mass-analyzing said ions.

63. A method for analysis comprising the steps of: preparing a solution sample; separating a predetermined matter in said sample solution; nebulizing or vaporizing a solution containing the separated predetermined matter; forming a particle stream containing ions of nebulized or vaporized predetermined matter; focusing said ions contained in said particle stream; limiting a flow path before deflecting said ions of said particle stream; deflecting an orbit of said ions; and mass-analyzing said ions.

64. An apparatus for mass analysis comprising: a sample supply means for supplying a sample in solution; at least one of a nebulizer and vaporizer for nebulizing and/or vaporizing the sample solution; an ion generation means for ionizing a predetermined matter in the nebulized or vaporized sample solution to thereby form a particle stream constituted by electrically charged particles and neutral particles; a differential pumping means including an aperture for leading said particle stream to a vacuum analysis portion, and an electric source for applying a voltage to said aperture; a focusing means for focusing said electrically charged particles contained in said particle stream; a deflection means for deflecting said electrically charged particles; a mass spectrometer means for measuring physical quantities of the deflected electrically charged particles; and a limit means for limiting a flow path of said particle stream, said limit means being provided between said focusing means and said mass spectrometer means.

65. An apparatus for mass analysis comprising: a sample supply means for supplying a sample in solution; at least one of a nebulizer and vaporizer for nebulizing and/or vaporizing the sample solution; an ion generation means for ionizing a predetermined matter in the nebulized or vaporized sample solution to thereby form a particle stream constituted by electrically charged particles and neutral particles; a differential pumping means including an aperture for leading said particle stream to a vacuum analysis portion, and an electric source for applying a voltage to said aperture; a focusing means for focusing said electrically charged particles contained in said particle stream; a deflection means for deflecting said electrically charged particles; an ion trap mass analysis means for measuring physical quantities of the deflected electrically charged particles; and a limit means for limiting a flow path of said particle stream, said limit means being provided between said focusing means and said ion trap mass analysis means.

66. An apparatus for mass analysis comprising:

a separation means for separating a matter contained in a sample solution;

a nebulization and/or vaporization means for nebulizing and/or vaporizing a solution obtained from said separation means;

an ion generation means for ionizing a predetermined matter in nebulized or vaporized sample solution to thereby form a particle stream constituted by electrically charged particles and neutral particles;

a differential pumping means including an aperture for leading said particle stream to a vacuum analysis portion, and an electric source for applying a voltage to said aperture;

a focusing means for focusing said electrically charged particles contained in said particle stream;

a deflection means for deflecting said electrically charged particles;

a mass analysis means for measuring physical quantities of the deflected electrically charged particles; and a limit means for limiting a flow path of said particle stream, said limit means being provided between said focusing means and said mass analysis means.

67. An apparatus for mass analysis comprising:

a separation means for separating a matter contained in a sample solution;

a nebulization and/or vaporization means for nebulizing and/or vaporizing a solution obtained from said separation means;

an ion generation means for ionizing a predetermined matter in nebulized or vaporized sample solution to thereby form a particle stream constituted by electrically charged particles and neutral particles;

a differential pumping means including an aperture for leading said particle stream to a vacuum analysis portion, and an electric source for applying a voltage to said aperture;

a focusing means for focusing said electrically charged particles contained in said particle stream;

a deflection means for deflecting said electrically charged particles;

a mass analysis means for measuring physical quantities of the deflected electrically charged particles; and a limit means for limiting a flow path of said particle stream, said limit means being provided between said focusing means and said mass analysis means;

wherein said separation means is a liquid chromatography.

68. An apparatus for mass analysis comprising:

a separation means for separating a matter contained in a sample solution;

a nebulization and/or vaporization means for nebulizing and/or vaporizing a solution obtained from said separation means;

an ion generation means for ionizing a predetermined matter in nebulized or vaporized sample solution to thereby form a particle stream constituted by electrically charged particles and neutral particles;

a differential pumping means including an aperture for leading said particle stream to a vacuum analysis portion, and an electric source for applying a voltage to said aperture;

a focusing means for focusing said electrically charged particles contained in said particle stream;

a deflection means for deflecting said electrically charged particles;

a mass analysis means for measuring physical quantities of the deflected electrically charged particles; and a limit means for limiting a flow path of said particle stream, said limit means being provided between said focusing means and said mass analysis means;

wherein said separation means is a capillary electrophoresis.

69. An apparatus for mass analysis comprising: a sample supply means for supplying a sample in solution; at least one of a nebulizer and vaporizer for nebulizing and/or vaporizing the sample solution; an ion generation means for ionizing a predetermined matter in the nebulized or vaporized sample solution to thereby form a particle stream constituted by electrically charged particles and neutral particles; a differential pumping means including an aperture for leading said particle stream to a vacuum analysis portion, and an electric source for applying a voltage to said aperture; a focusing means for focusing said electrically charged particles contained in said particle stream; a deflection means for deflecting said electrically charged particles; an ion trap mass analysis means for measuring physical quantities of the deflected electrically charged particles; a limit means for limiting a flow path of said particle stream, said limit means being provided between said focusing means and said ion trap mass analysis means; and a control means for controlling said electrically charged particles, said control means being provided between said deflection means and said ion trap mass analysis means.

* * * * *

UNITED STATES PATENT AND TRADEMARK OFFICE

CERTIFICATE OF CORRECTION

PATENT NO. : 5,663,560

DATED : September 2, 1997

INVENTOR(S) : Minoru Sakairi, et al

It is certified that error appears in the above-identified patent and that said Letters Patent is hereby corrected as shown below:

| Column | Line | |
|---|---|---|
| 1 | 8 | Change "5,487,107" to --5,481,107--. |
| 2 | 59 | After "that" delete ",". |
| 4 | 50 | Change "lib" to --11B--. |
| 5 | 5 | After "method" delete "which". |
| 5 | 17 | Change "used)" to --used,--. |
| 5 | 54 | Change "reduce." to --reduced.--. |

Signed and Sealed this

Third Day of March, 1998

Bruce Lehman

*Attest:*

BRUCE LEHMAN

*Attesting Officer*

*Commissioner of Patents and Trademarks*